United States Patent [19]

Padovani

[11] Patent Number: 4,529,531

[45] Date of Patent: Jul. 16, 1985

[54] ELECTRICAL CONTACT LUBRICANT COMPOSITION AND METHOD OF LUBRICATION

[75] Inventor: Frank L. Padovani, Port Chester, N.Y.

[73] Assignee: Stauffer Chemical Company, Westport, Conn.

[21] Appl. No.: 582,352

[22] Filed: Feb. 22, 1984

[51] Int. Cl.[3] ..... C10M 1/26; C10M 3/20

[52] U.S. Cl. ..... 252/56 S; 252/50; 252/32.5

[58] Field of Search ..... 252/56 S, 32.7 E, 32.5, 252/50

[56] References Cited

U.S. PATENT DOCUMENTS 3,778,454 12/1973 Kleiman et al. ..... 252/56 S
3,923,702 12/1975 Sturwold et al. ..... 252/56 S
4,113,642 9/1978 Koch et al. ..... 252/56 S

FOREIGN PATENT DOCUMENTS 2086418 5/1982 United Kingdom .

OTHER PUBLICATIONS

W. O. Freitag, "Lubricants for Separable Connectors:, *Electr. Contacts, Proc. Annu. Holm. Semin.* 1976, 22, 57–63.

W. E. Campbell, "The Lubrication of Electrical Contacts", *IEEE Trans. on Components, Hybrids, and Manufacturing Technology,* vol. No. 1, Mar. 1978, 4–16.

R. V. Steenstrup et al., "A Comparative Study of Inhibited Lubricants for Dry Circuits Sliding Contacts", *IEEE Transactions on Components, Hybrids and Manufacturing Technology,* vol. CHMT-6, No. 1, Mar. 83, 37–44.

G. Kovacs, "Lubricants for Electrical Contacts Used in Telecommunications", *Proc. Int. Conf. Electr. Contact. Phenom.,* 10th 1980, 1, 475–488.

95 *Chemical Abstracts* 172412 p(1981) abstracting Jpn. Tokkyo Koho 81/23480.

95 *Chemical Abstracts* 172427 x (1981), Abstracting Jpn. Kokai Tokkyo Koho 81/82894.

*Primary Examiner*—Jacqueline V. Howard
*Attorney, Agent, or Firm*—Richard P. Fennelly

[57] ABSTRACT

An electric contact lubricant is disclosed which comprises a predominant amount of an evaporable solvent and a lubricant which, in turn, comprises a predominant amount of a partially crosslinked polyol ester formed by esterification of an aliphatic monocarboxylic acid with an aliphatic polyol in the presence of a dibasic acid crosslinker, a lesser amount of a phosphate ester fluid, and one or more corrosion and oxidation inhibitor compounds.

26 Claims, No Drawings

ELECTRICAL CONTACT LUBRICANT COMPOSITION AND METHOD OF LUBRICATION

BACKGROUND OF THE INVENTION

The present invention relates to an electrical contact lubricant composition and to a method of lubrication using it.

Electrical contact lubricants are specialized products which require certain characteristics: good metal wetting properties; good electrical properties; an acceptable degree of high temperature oxidative stability; good corrosion resistance; and lack of undesired reactivity in regard to materials adjacent to the electric contact assembly itself. Various types of lubricants have been suggested for such end use applications.

A lubricant for electric contacts comprising pressure gas (FREON brand), solvent (FREON TF brand), a high-stability perfluorinated polyether, and an originally wax-like fraction of a perfluorinated hydrocarbon is described in Proc. Int. Conf. Electr. Contact Phenom., 10th, 1980, 1, 475–488. Japanese Tokkyo Koko No. 81/23,480 describes a lubricating grease for electrical contacts containing pure mineral oil, a lithium soap, and magnesium hydroxide. Japanese Kokai Tokkyo Koko No. 81/82,894 advocates a siloxane based lubricant containing smaller amounts of powdered silicon dioxide, an aliphatic aluminum salt, and a sulfur-containing lubricity improver. A lubricant composition formed by blending dicarboxylic esters, e.g., bis(2-ethylhexyl)adipate, with derivatives of pyrazolidone and/or triazoles is suggested in French Pat. No. 2,493,335. Various polyphenyl ethers, natural and synthetic hydrocarbons, esters, polyglycols, fluorinated materials, silicones, and proprietary formulations were reported as being tested as lubricants for separable connectors in Electr. Contacts, Proc. Annu. Holm Semin. 1976, 22, 57–63.

SUMMARY OF THE PRESENT INVENTION

The present invention relates to an electrical contact lubricant and its use to lubricate electrical contacts. The lubricant of the present invention contains a predominant amount of an evaporable solvent and a lesser amount of a lubricant comprising a predominant amount of a partially crosslinked polyol ester in combination with a small amount of a triaryl phosphate fluid.

DETAILED DESCRIPTION OF THE PRESENT INVENTION

The type of evaporable solvent which is useful in connection with present invention comprises a predominant part of the present composition, e.g., from about 75% to about just under 100% (e.g. 99.99%), by weight of the entire composition. It is preferably a solvent which has a high degree of room temperature volatility (e.g., a boiling point under about 50° C., preferably well under that temperature, for example, below 30° C.). The solvent is one which should leave no deposits of its own on the electrical contacts and it should insure a smooth even coverage of the contacts with the lubricant composition it carries. The preferred solvents of choice are the halogenated lower alkanes, e.g., those containing both chloro and fluoro substituents since they have attractively high flash points and are therefore of low flammability. A preferred solvent is 1,1,2-trichloro-1,2,2,-trifluoroethane which is sold under the trademark FREON TF by Du Pont.

The present lubricant composition also contains a lesser amount than the evaporable solvent, e.g., up to 25% of the entire composition, of a lubricant containing a predominant amount of a partially crosslinked polyol ester in combination with a small amount of a triaryl phosphate fluid. The ester is an esterification reaction product of an aliphatic monocarboxylic and an aliphatic polyol in the presence of a minor amount of dibasic acid as crosslinking agent.

The aliphatic monocarboxylic acids used in accordance with this invention are compounds or mixtures of compounds having average chain lengths of from about 4 to about 12 carbon atoms, preferably from about 5 to about 9 carbon atoms. The individual acids can range in chain length from about 2 to about 18 carbon atoms. Normal acids are preferred, although branched monocarboxylic acids can also be used, particularly those with no more than two carbon atoms in side chains.

In synthesizing the partially crosslinked polyol esters, minor amounts (e.g., from about 0.1 to about 10%, by weight of the polyol) of dibasic acids are employed as crosslinking agents in order to increase (or build) the viscosity of the normal uncrosslinked polyol ester. The alkyl or aryl portion of the dibasic acid generally ranges from about 2 to about 18 carbon atoms, more preferably from about 4 to about 12 carbon atoms. Particularly preferred dibasic acids include adipic, azelaic, isophthalic, and mixtures thereof. Also included for purposes of crosslinking are the dimer and trimer acids and mixtures thereof.

The polyols used are those having at least two, and preferably at least three, methylol groups on a quaternary carbon atom. Among the polyols which can be used are trimethylolpropane, trimethylolethane, neopentyl glycol, pentaerythritol, 2-butyl-2-ethyl-1,3-propanediol, 2,2,4-trimethyl-1,3-pentanediol, and mixtures thereof.

Also included within the definition of polyols are those polyols which are formed from either condensation of two or more polyols within the definition above, provided that no more than four polyol units are so condensed and further provided that at least four OH groups are available.

Generally speaking, the polyol ester component of the present lubricant will comprise a predominant portion of the lubricant composition carried by the evaporable solvent. Representative amounts range from about 93% to about 97%, by weight of the lubricant carried by the solvent.

Another component of the present lubricant carried by the solvent, which is used in much lower amount than the partially crosslinked polyol ester, is a triaryl phosphate fluid such as tricresyl phosphate. It is present at from about 0.1%–5%, preferably 1–3%, by weight of the lubricant. It contributes to the desired degree of fluid cleanliness when the lubricant is used by possibly passivating such metal species as iron. It also aids in lubricating the contacts, and it has an affinity for metal surfaces which is also desired.

In addition to the foregoing products, the lubricant carried by the solvent advantageously also contains one or more oxidation and corrosion inhibitors to give the final lubricant the desired degree of oxidation and corrosion inhibition. The total weight for these ingredients can range from about 1%–3%, by weight of the lubricant which is carried by the solvent.

Organic compounds which contain sulfur, nitrogen, phosphorus or alkylphenols and which have utility in inhibiting oxidation in polyol ester lubricant fluids can be used in conjunction with the present invention. Preferred are aromatic amine oxidation inhibitors, particularly those of the formula

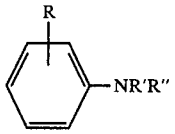

where R can be hydrogen or alkyl, R' can be hydrogen or alkyl, and R'' can be hydrogen, phenyl, naphthyl, aminophenyl or alkyl substituted phenyl. The size of the alkyl moiety can range from 1 to about 8–10. Representative compounds include N,N'-dioctyldiphenylamine, 4-octyl-N-(4-octylphenyl)benzenamine, and phenyl-alpha-naphthylamine. Representative amounts can range from about 0.1% to about 2%, by weight of the lubricant carried by the solvent.

A corrosion inhibitor for the metal forming the electric contact (e.g., copper) can also be included in the lubricant which is carried by the solvent. Representative amounts range from about 0.005% to about 0.1%, by weight of the lubricant, with such compounds as the dialkyl thiadiazoles, benzotriazole, purpurxanthrene, anthrarufin, and chrysazin being useful.

The type of evaporable solvent described before must be air evaporable. The evaporation rate should not be so rapid as to lead to condensation of unwanted moisture on the electrical contacts. The rate needs, however, to be sufficiently rapid and complete to insure removal of substantially all the solvent from the area to be lubricated.

The following Examples illustrate certain embodiments of the present invention.

EXAMPLE 1

This Example illustrates formation of the electrical contact lubricant which, when mixed with evaporable solvent, results in the composition of the present invention.

The following ingredients were blended in the weights given below to form the lubricant. The pentaerythritol ester was charged into a blending vessel equipped with heating and stirring devices. This base oil was then heated with agitation as all the preweighed additives were added. Heating and agitation were continued until the additives were completely dissolved—about 30 minutes with a maximum temperature of 105° C. Stirring continued as the blend was allowed to cool. Cooling under agitation was continued until a safe handling temperature was attained. The product was then filtered (10μ) into the final containers.

| Ingredient | Parts By Weight | Approx. % By Weight |
|---|---|---|
| Pentaerythritol ester of $C_7$ acid crosslinked with azelaic acid (BASE STOCK 810 from Stauffer Chemical Company) | 3839.2 | 95.98 |
| Natural cresylic acid based tricresyl phosphate (SYN-O-AD 8484 from Stauffer Chemical Company) | 80.0 | 2.0 |
| Benzotriazole corrosion inhibitor | 0.80 | 0.02 |
| 4-octyl-N—(4-octylphenyl)benzenamine oxidation inhibitor (VANLUBE 81 brand from R. T. Vanderbilt and Company) | 40.0 | 1.0 |
| Phenyl-alpha-naphthylamine corrosion inhibitor | | |
| Silicone antifoam (SWS 101 brand from SWS Silicones) | 10 parts by weight per million parts by wgt. of the entire composition. | |

The lubricant described above had the following physical properties:

| Properties | Value |
|---|---|
| Viscosity (in cs) | |
| at 210° F. (98.9° C.) | 11.34 |
| at 100° F. (37.8° C.) | 76.66 |
| at 0° F. (−17.8° C.) | 3692.2 |
| Pour Point | |
| (°F.) | −34. |
| (°C.) | −36.7 |
| Evaporation Rate (% Loss) at 300° F. (148.8° C.) - 22 hours | 0.4 |
| Acid number (mg KOH/gm) | 0.09 |
| Auto Ignition temp. | |
| (°F.) | 865 |
| (°C.) | 462.8 |
| Flash Point | |
| (°F.) | 545 |
| (°C.) | 285 |
| Fire Point | |
| (°F.) | 615 |
| (°C.) | 323.9 |

EXAMPLE 2

Listed below are some additional physical performance data for the lubricant described in Example 1.

| Oxidation - Corrosion Federal Standard Test Method 791a, Method 5308 | 72 Hr. 347° F. (175° C.) | 48 Hr. 425° F. (218.3° C.) |
|---|---|---|
| 100° F. (37.8° C.) Viscosity | | |
| Increase, % | 3.4 | 13.5 |
| Δ TAN | 0.24 | 1.71 |
| Metal Corrosion, mg/cm$^2$ | | |
| Magnesium | −0.05 | −0.24 |
| Steel | −0.05 | +0.10 |
| Aluminum | +0.01 | +0.05 |
| Silver | 0 | +0.08 |
| Copper | +0.10 | 0 |
| % Insolubles | NIL | 1.0 |

| Volatility | |
|---|---|
| Test Method: | ASTM D972 |
| Duration: | 6.5 Hours |
| Temperature, °F. | % Loss |
| 300 (148.9° C.) | 0.09 |
| 350 (176.7° C.) | 0.34 |
| 400 (204.4° C.) | 1.1 |

EXAMPLE 3

This Example illustrates the composition of the present invention.

The following blends were made to formulate a spray for electrical contacts using the composition of Example 1 with a trichlorinated/trifluorinated evaporable solvent. All amounts given below are in parts by weight.

| Ingredient | Formulation A | B | C |
|---|---|---|---|
| Composition from Example 1 | 0.01 | 0.1 | 1.0 |
| 1,1,2-trichloro-1,2,2, trifluoroethane (FREON TF brand from Du Pont) | 99.99 | 99.9 | 99.0 |

The foregoing Examples illustrate certain embodiments of the present invention but should not be construed in a limiting sense. The scope of protection sought is set forth in the claims which follow.

What is claimed:

1. A lubricant composition for electric contacts which comprises a predominant amount of an evaporable solvent and a lubricant which comprises a predominant amount of a partially crosslinked polyol ester, which is the esterification reaction product of an aliphatic monocarboxylic acid and an aliphatic polyol in the presence of a dibasic acid crosslinker, a lesser amount of a phosphate ester fluid and at least one inhibitor compound.

2. A lubricant composition as claimed in claim 1 wherein the evaporable solvent comprises from about 75% to about just under 100% by weight of the composition.

3. A lubricant composition as claimed in claim 1 wherein the solvent is a halogenated alkane having a boiling point under about 50° C.

4. A lubricant composition as claimed in claim 1 wherein the solvent is 1,1,2-trichloro-1,2,2-trifluoroethane.

5. A lubricant composition as claimed in claim 1 wherein the monocarboxylic acid has an average chain length of from about 4 to about 12 carbon atoms and the polyol has at least two methylol groups on a quaternary carbon atom.

6. A lubricant composition as claimed in claim 1 wherein the monocarboxylic acid has a chain length of about seven and the polyol is pentaerythritol.

7. A lubricant composition as claimed in claim 1 wherein the dibasic acid crosslinker has an alkyl portion of from about 2 to about 18 carbon atoms.

8. A lubricant composition as claimed in claim 1 wherein the dibasic acid crosslinker is azelaic acid.

9. A lubricant composition as claimed in claim 1 which comprises from about 75% to about just under 100% by weight of an evaporable halogenated alkane solvent with the remainder being a lubricant which comprises from about 93% to about 97%, by weight, of the partially crosslinked polyol ester, from about 1% to about 3%, by weight, of a triaryl phosphate fluid, and from about 1% to about 3% by weight of the inhibitor compound.

10. A lubricant composition as claimed in claim 9 in which the ester is the pentaerythritol ester of a $C_7$ acid crosslinked with azelaic acid and the triaryl phosphate is tricresyl phosphate.

11. A lubricant composition as claimed in claim 9 wherein the inhibitor compound is selected from benzotriazole, phenyl alpha naphthylamine, and mixtures thereof.

12. A lubricant composition as claimed in claim 9 wherein the inhibitor compound is 4-octyl-N-(4-octylphenyl)-benzenamine.

13. A lubricant composition as claimed in claim 9 wherein the evaporable halogenated alkane solvent is 1,1,2-trichloro-1,2,2-trifluoroethane.

14. A method for the lubrication of electric contacts which comprises adding thereto the lubricant composition of claim 1.

15. A method for the lubrication of electric contacts which comprises adding thereto the lubricant composition of claim 2.

16. A method for the lubrication of electric contacts which comprises adding thereto the lubricant composition of claim 3.

17. A method for the lubrication of electric contacts which comprises adding thereto the lubricant composition of claim 4.

18. A method for the lubrication of electric contacts which comprises adding thereto the lubricant composition of claim 5.

19. A method for the lubrication of electric contacts which comprises adding thereto the lubricant composition of claim 6.

20. A method for the lubrication of electric contacts which comprises adding thereto the lubricant composition of claim 7.

21. A method for the lubrication of electric contacts which comprises adding thereto the lubricant composition of claim 8.

22. A method for the lubrication of electric contacts which comprises adding thereto the lubricant composition of claim 9.

23. A method for the lubrication of electric contacts which comprises adding thereto the lubricant composition of claim 10.

24. A method for the lubrication of electric contacts which comprises adding thereto the lubricant composition of claim 11.

25. A method for the lubrication of electric contacts which comprises adding thereto the lubricant composition of claim 12.

26. A method for the lubrication of electric contacts which comprises adding thereto the lubricant composition of claim 13.

* * * * *